US005845508A

United States Patent [19]

Takeda

[11] Patent Number: 5,845,508

[45] Date of Patent: Dec. 8, 1998

[54] ELECTRIC APPLIANCE OR REFRIGERATOR WITH INDICATOR FOR ELECTRIC CONTROLLER APPLIED THERETO

[75] Inventor: Yukimasa Takeda, Nagoya, Japan

[73] Assignee: Hoshizaki Denki Kabushiki Kaisha, Toyoake, Japan

[21] Appl. No.: 920,885

[22] Filed: Aug. 29, 1997

[51] Int. Cl.[6] ..... F25B 49/02

[52] U.S. Cl. ..... 62/127; 62/298; 340/825.17

[58] Field of Search ..... 62/125, 126, 127, 62/298; 236/94; 165/11.1, 11.2; 340/286.01, 286.11, 825, 825.17

[56] References Cited

U.S. PATENT DOCUMENTS 4,545,210 10/1985 Lord ..... 62/127
5,119,088 6/1992 Kemp et al. ..... 340/825.17
5,299,432 4/1994 Nakae et al. ..... 62/298
5,628,199 5/1997 Hoglund et al. ..... 62/127 X

*Primary Examiner*—Harry B. Tanner
*Attorney, Agent, or Firm*—Nikaido, Marmelstein, Murray & Oram LLP

[57] ABSTRACT

An electric appliance such as a refrigerator equipped with an operation switch, an indicator and an electric controller for controlling operation of the appliance when connected to a source of electric power, wherein the electric controller is designed to memorize a data indicative of the type of the electric controller for activating the indicator to display the type of the electric controller for a predetermined time based on the memorized data when the electric appliance is connected to the source of electric power in a condition where the operation switch was closed and for disabling the indicator to display the type of the electric controller when the electric appliance is connected to the source of electric power in a condition where the operation switch is maintained in an open position.

4 Claims, 3 Drawing Sheets

ELECTRIC APPLIANCE OR REFRIGERATOR WITH INDICATOR FOR ELECTRIC CONTROLLER APPLIED THERETO

BACKGROUND OF THE INVENTION

1. Field of the Invention

The present invention relates to an electric appliance or a refrigerator equipped with an electric controller, and more particularly to an electric appliance or a refrigerator provided with an indicator for display of the type of an electric controller applied thereto.

2. Description of the Prior Art

In a conventional electric appliance such as a refrigerator, there is provided with an electric controller for operation control of the electric appliance or refrigerator. The electric controller is composed of electric parts mounted on a printed board which are different in accordance with each model or type of the electric appliances. In the case that the electric parts are provided in the form of a microcomputer, different program and data are stored In a EEPROM, an EPROM, a PROM or a ROM in accordance with each model or type of the electric appliances. It Is, however, difficult to identify the electric parts on the printed board in appearance. For this reason, an error in installation of the electric controller is apt to be overlooked in shipment of the electric appliances.

SUMMARY OF THE INVENTION

It is, therefore, a primary object of the present invention to provide an electric appliance or a refrigerator equipped with an indicator useful for inspecting an error in installation of an electric controller in a simple manner in shipment of the electric appliance or refrigerator.

According to the present invention, the object is accomplished by providing an electric appliance equipped with an operation switch, an indicator and an electric controller for controlling operation of the appliance when connected to a source of electric power, wherein the electric controller comprises memory means for memorizing a data indicative of the type of the electric controller, and means for activating the indicator to display the type of the electric controller for a predetermined time based on the memorized data when the electric appliance is connected to the source of electric power in a condition where the operation switch was closed and for disabling the Indicator to display the type of the electric controller when the electric appliance Is connected to the source of electric power in a condition where the operation switch is maintained in an open position.

According to an aspect of the present invention, there is provided a refrigerator equipped with a temperature sensor for detecting an inside temperature of the refrigerator, a temperature setting device for setting the inside temperature of the refrigerator to a desired temperature, a freezing device composed of a compressor, a condenser and an evaporator, an indicator arranged to be activated under control of an operation switch to display the inside temperature of the refrigerator detected by the temperature sensor and the desired temperature set by the temperature setting device, and an electric controller for controlling the freezing device in such a manner that the inside temperature of the refrigerator is maintained at the desired temperature set by the temperature setting device and for activating the indicator to display the inside temperature of the refrigerator detected by the temperature sensor or the desired temperature set by the temperature setting device under control of the operation switch, wherein the electric controller comprises memory means for memorizing a data indicative of the type of the electric controller, and means for activating the indicator to display the type of the electric controller based on the memorized data for a predetermined time when the refrigerator is connected to a source of electric power in a condition where the operation switch was closed and for disabling the indicator to display the type of the electric controller when the refrigerator is connected to the source of electric power in a condition where the operation switch is maintained in an open position.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
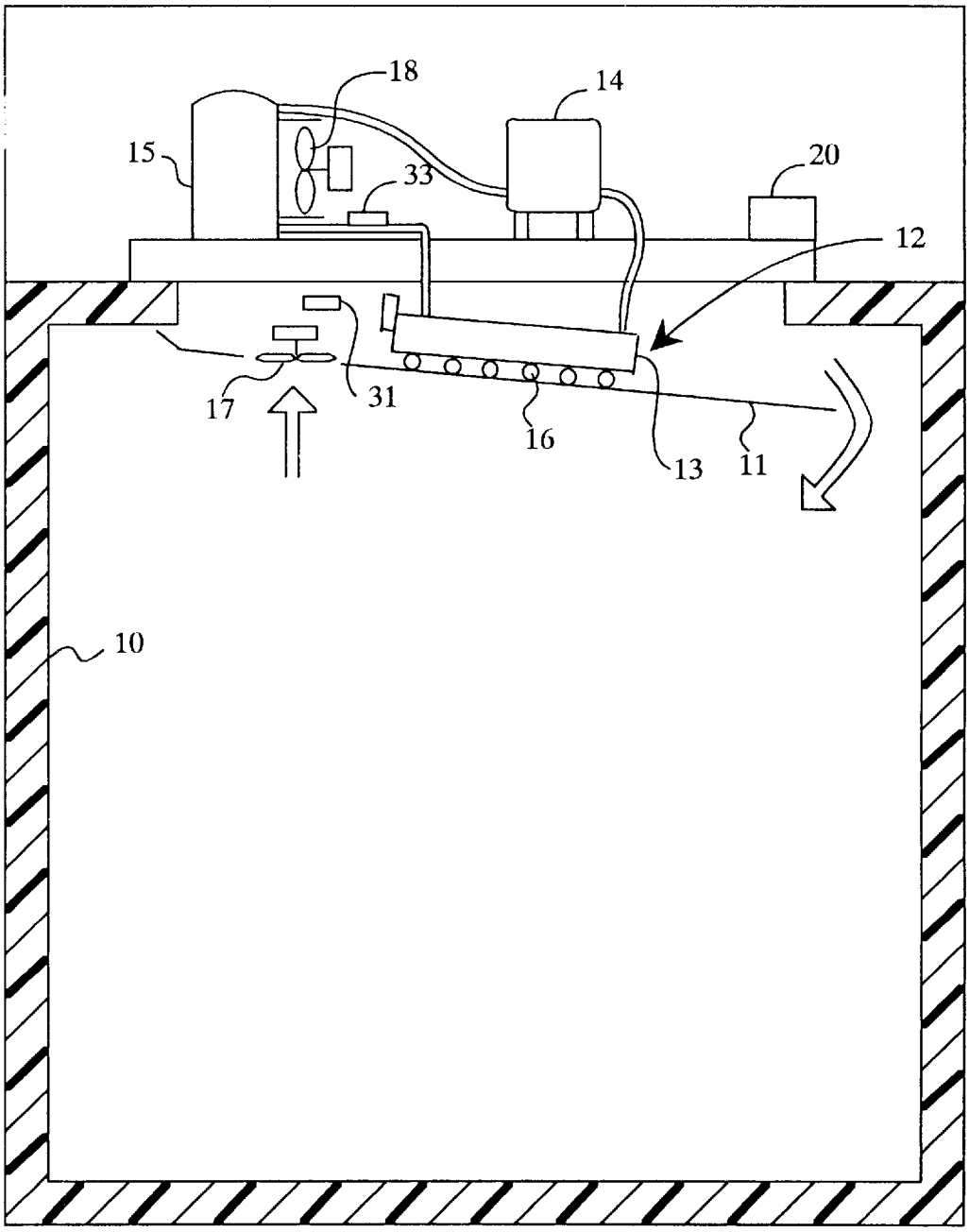
FIG. 1 is a sectional view of an electric refrigerator equipped with an indicator for an electric controller in accordance with the present invention.

In FIG. 1 of the drawings, there is illustrated an electric refrigerator equipped with an indicator 36 for an electric controller 20A in accordance with the present invention. The refrigerator is provided with a cooling chamber 12 formed by a partition plate 11 at an upper portion of a housing 10 and a storage cabinet located under the cooling chamber 12 to store foodstuffs. An evaporator 13 is mounted on the partition plate 11 to evaporate refrigerant supplied from a compressor 14 and condensed by a condenser 15 thereby to lower the temperature in the cooling chamber 12. The evaporated refrigerant is returned to the compressor 14. In the refrigerator, a freezing device is composed of the evaporator 13, compressor 14 and condenser 15. A defrost heater 16 is assembled with the bottom of evaporator 13 for melting frosts adhered thereto. A cooling fan 17 is mounted within the cooling chamber 12 to introduce the air into the cooling chamber 12 from the storage cabinet through an opening formed in the partition plate 11 and to circulate the cooled air into the storage cabinet from the cooling chamber 12. In addition, the condenser 15 is provided with a cooling fan 18.

Figure 2:
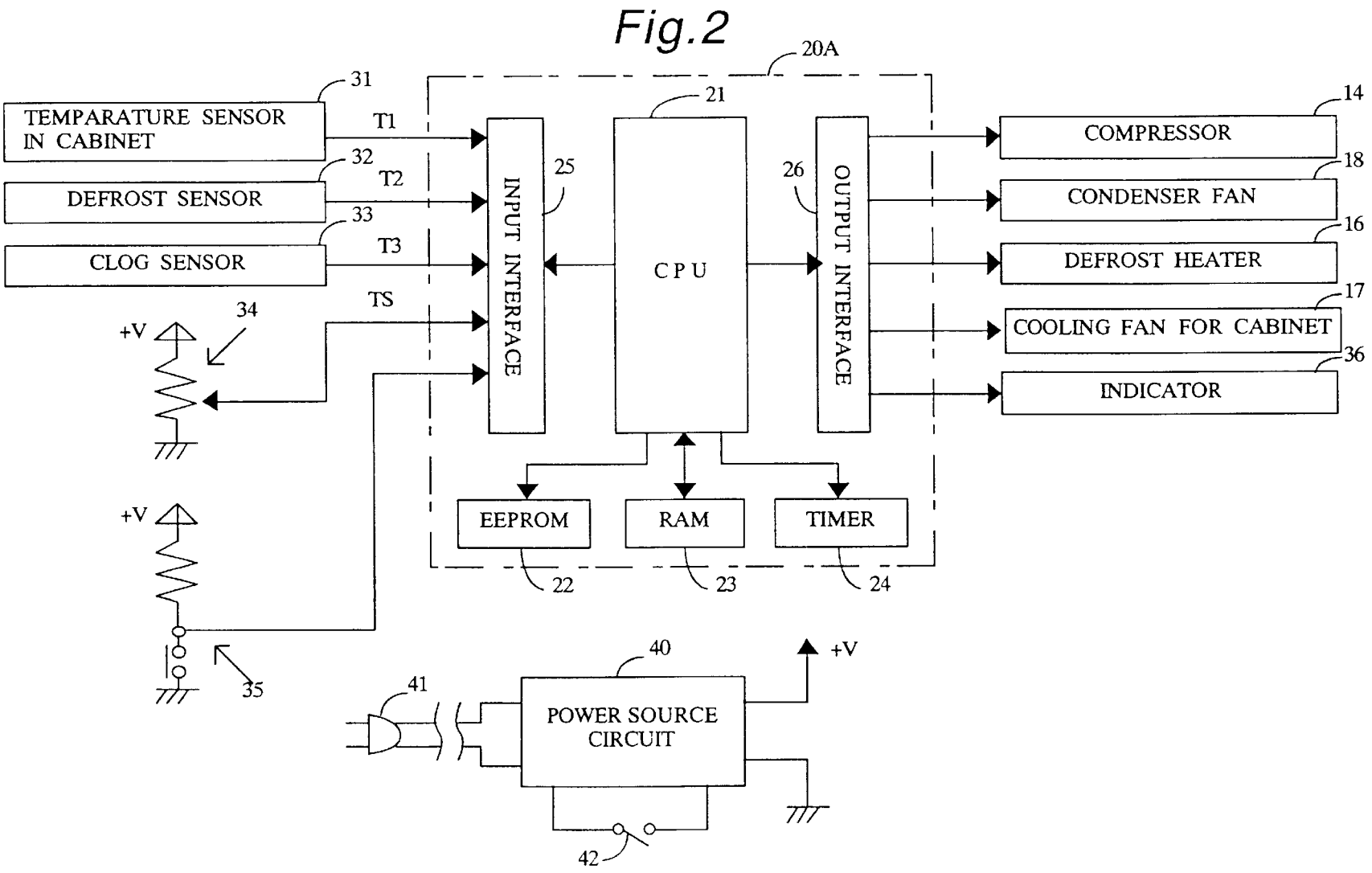
FIG. 2 is a block diagram of the electric controller provided within the refrigerator shown in FIG. 1.

The refrigerator is provided therein with a control box 20 which contains the electric controller 20A mounted on a printed board. As shown in FIG. 2, the electric controller 20A includes a central processing unit or CPU 21, an EEPROM 22, a RAM 23, a timer 24, an input interface 25 and an output interface 26. The EEPROM 22 is designed to memorize a data indicative of the type of the electric controller 20A and a program shown by a flow chart in FIG. 3. Allotted in the data indicative of the type of the electric controller 20A are a character "A1" indicative of a first type refrigerator only for refrigeration, a character "A2" indicative of a second type refrigerator only for refrigeration, a character "B1" indicative of a first type refrigerator for refrigeration and freezing, a character "B2" indicative of a second type refrigerator for refrigeration and freezing, a character "C1" indicative of a first type freezer only for freezing, and a character "C2" indicative of a second type freezer only for freezing. In a practical embodiment of the present invention, the EEPROM 22 may be replaced with an EPROM, a PROM or a ROM. Alternatively, the EEPROM 22 may be used in combination with a EPROM, a PROM and a ROM.

The input interface 25 is connected to a temperature sensor 31, a defrost sensor 32, a clog sensor 33, a temperature setting device 34 and an operation switch 35 of the normally open type. The temperature sensor 31 is disposed in the cooling chamber 12 to detect an inside temperature T1 of the refrigerator for producing a detection signal indicative of the detected inside temperature T1. The defrost sensor 32 is in the form of a temperature sensor assembled within the evaporator 21 to detect a defrost temperature of evaporator 21 for producing a detection signal indicative of the detected defrost temperature T2. The clog sensor 33 is in the form of a temperature sensor disposed in an output pipe of condenser 15 to detect a temperature of refrigerant at the output side of condenser 15 for producing a detection signal indicative of the detected refrigerant temperature T3. The temperature setting device 34 and operation switch 35 are mounted on an operation panel (not shown) to be operated by a user. The temperature setting device 34 is in the form of a potentiometer capable of setting the inside temperature of the refrigerator to a desired temperature and of producing a signal indicative of the set temperature Ts. The operation switch 35 is arranged to selectively display the inside temperature T1 of the refrigerator and the set temperature Ts and to output a power-supply voltage +V when it is closed. When closed, the operation switch 35 outputs a ground voltage. The signals applied from the sensors 31–32 and temperature setting device 34 are converted into digital signals at the input interface 25.

The output interface 26 is connected to the compressor 14, the cooling fan 18 for condenser 15, the defrost heater 16 and the cooling fan 17 in cooling chamber 12 and is further connected to an indicator 36. The indicator 36 is in the form of an indicator of plural digits for seven segments mounted on the operation panel to display the detected inside temperature of the refrigerator and the set temperature Ts. The refrigerator is provided with a power source circuit 40 which is applied with power-supply voltage +V from a source of electric power through a connector 41 to supply the power-supply voltage +V to the foregoing circuits and devices when a power source switch 42 on the operation panel is closed.

Figure 3:
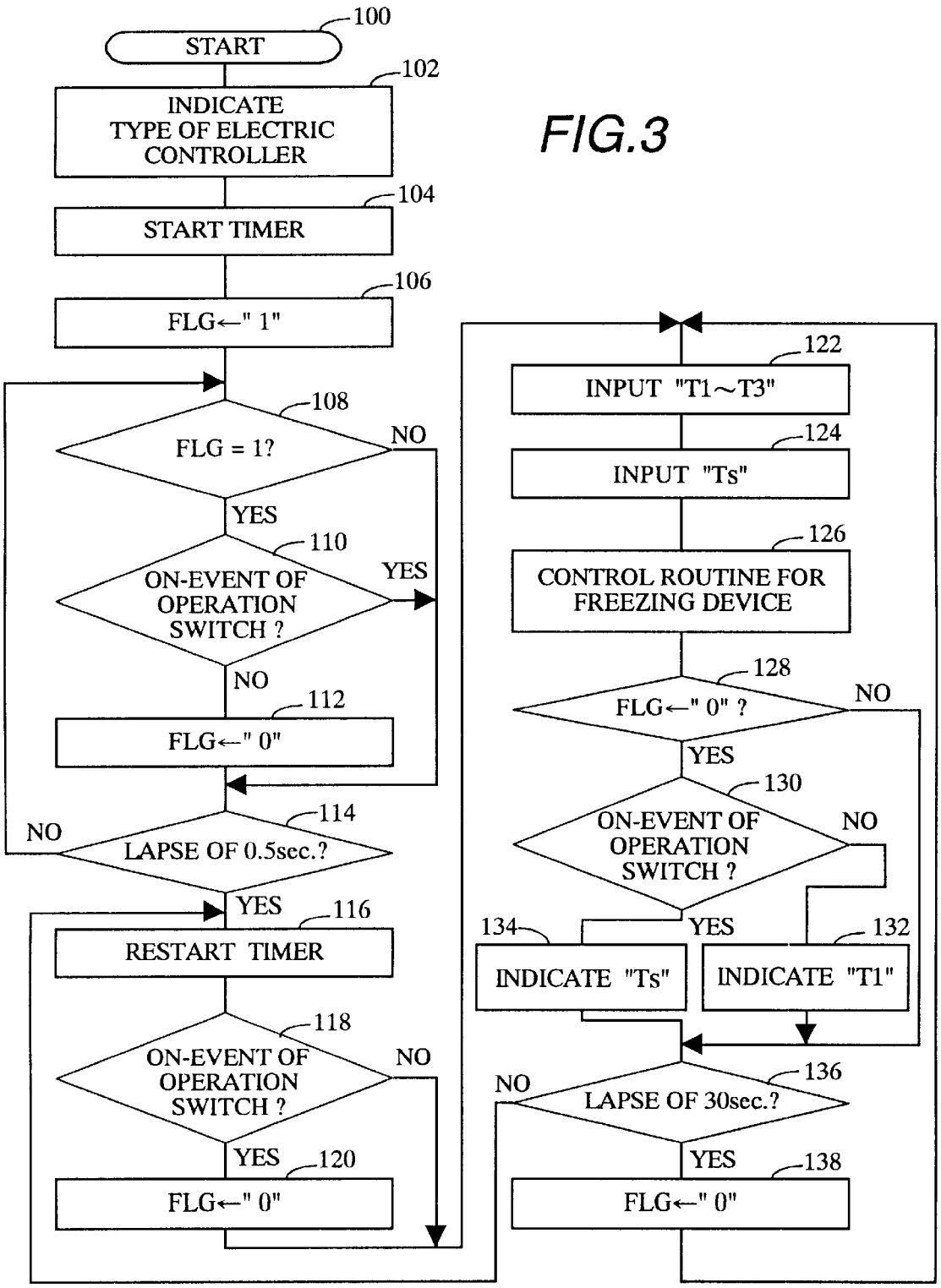
FIG. 3 is a flow chart of a control program executed by a microcomputer shown in FIG. 2.

Hereinafter, operation of the refrigerator will be described with reference to a flow chart shown in FIG. 3. When the power source switch 42 is closed in a condition where the connector 41 is connected to the source of electric power, the foregoing circuits and devices are applied with the power-supply voltage +V, and the CPU 21 starts at step 100 to execute the program shown by the flow chart in FIG. 3. At step 102, the CPU 21 reads out a data indicative of the type of the electric controller 20A to apply the data to the indicator 36 through the output interface 26. When applied with the data, the indicator 36 is activated to indicate the type (for example, A1, AZ, B1, B2, C1 or C2) of the electric controller 20A. After processing at step 102, the CPU 21 causes the timer 24 at step 104 to start for measurement of a predetermined time (for example, 0.5 sec), sets a flag FLG as "1" at step 106 and repeats execution of processing at step 108 to 114.

The processing at step 108 to 114 is executed by the CPU 21 until a "Yes" answer is determined at step 114 upon lapse of the predetermined time. If the operation switch 35 is closed once during execution of processing at step 108 to 114 or maintained in its open position after the power source switch 42 was closed, the flag FLG is changed to "0" by processing at step 108 to 112. If the operation switch 35 is maintained in its closed position for the predetermined time after the power source switch 42 was closed, the flag FLG is maintained as "1". During execution of processing at step 108 to 114, the indicator 36 is activated for the predetermined time to display the type of the electric controller 20A.

Upon lapse of the predetermined time, the CPU 21 determines a "Yes" answer at step 114 and restarts the timer 24 at step 116. Subsequently, the CPU 21 causes the program to proceed to step 122 to 126 through step 118 and 120. At step 122, the CPU 21 reads out an inside temperature T1 of the refrigerator, a defrost temperature T2 and a refrigerant temperature T3 detected by the temperature sensor 31, defrost sensor 32 and clog sensor 33. At the following step 124, the CPU 21 reads out a desired temperature Ts set by the temperature setting device 34. Thereafter, the CPU 21 executes at step 126 a control routine for the freezing device in accordance with the detected temperatures T1–T3 and set temperature Ts.

When the inside temperature T1 of the refrigerator becomes higher than an upper limit temperature defined by addition of a predetermined small temperature to the set temperature Ts during execution of the control routine at step 126, the compressor 14 and the cooling fan 18 of condenser 15 are activated under control of the CPU 21 to lower the inside temperature of the refrigerator. When the inside temperature T1 of the refrigerator becomes lower than a lower limit temperature defined by subtraction of a predetermined small temperature from the set temperature Ts, the compressor 14 and the cooling fan 18 of condenser 15 are deactivated under control of the CPU 21 to rise the inside temperature of the refrigerator. With such control of the compressor 14 and the cooling fan 18 of condenser 15, the inside temperature of the refrigerator is maintained approximately at the set temperature Ts. In addition, the cooling fan 17 in cooling chamber 12 is maintained in activated condition during execution of the control routine.

After processing of the control routine at step 126, the CPU 21 determines at step 128 whether the flag FLG is "0" or not. If the operation switch 35 is maintained in its open position after the power source switch 42 was closed or maintained in its closed position for the predetermined time after the power source switch 42 was closed, the flag FLG is changed to "0". In this instance, the CPU 21 determines a "Yes" answer at step 128 and causes the program to proceed to step 130 to 134. If the operation switch 35 is not closed, the CPU 21 determines a "No" answer at step 130 and causes the indicator 36 at step 132 to change the display of the type of the electric controller 20A to a display of the inside temperature T1 of the refrigerator detected by the inside temperature sensor 31.

If the operation switch 35 is closed when the power source switch 42 was closed and is maintained in its closed position for the predetermined time, the flag FLU is maintained as "1". In this instance, the CPU 21 determines a "No" answer at step 128 and causes the program to proceed to step 136. At step 136, the CPU 21 determines whether or not a predetermined time (for example, 30 sec) has lapsed after the timer 24 was restarted at step 116. If the answer at step 136 is "No", the CPU 21 returns the program to step 118 to continually execute processing at step 118 to 135 for the predetermined time.

If the operation switch 35 is opened once and closed again during execution of processing at step 118 to 136, the CPU 21 determines a "Yes" answer at step 118 and changes at step 120 the flag FLG to "0". After the flag FLG was changed to "0", the CPU 21 determines a "Yes" answer at step 128 and causes the program to proceed to step 130 to 134. Thus, if the operation switch 35 is maintained in its closed position, the CPU 21 causes the indicator 386 at step 134 to change the display of the type of the electric controller 20A to display of the set temperature Ts. Thereafter, if the operation switch 35 is opened, the CPU 21 causes the indicator 36 to change the display of the set temperature Ts to a display of an inside temperature T1 of the refrigerator detected by the inside temperature sensor 31. Although in this instance, the flag FLG is changed to "0", the processing at step 130 to 134 is executed by the CPU 21 so that the type of the electric controller may not be displayed by the indicator 36.

When the predetermined time has lapsed during execution of the processing at step 118 to 136 after restart of the timer 24, the CPU 21 determines a "Yes" answer at step 136 and causes the program to proceed to step 138. At step 138, the CPU 21 sets the flag FLG as "0" and causes the program to proceed to step 122. Thereafter, the CPU 21 repeats execution of the processing at step 122 to 138. Since the flag FLG is set as "0" without fail upon each lapse of the predetermined time, the indicator 36 is activated by processing at step 130 to display the detected inside temperature T1 of the refrigerator or the set temperature Ts without displaying the type of the electric controller 20A. Thus, the inside temperature T1 of the refrigerator is maintained approximately at the set temperature Ts by processing at step 122 to 126.

During execution of the processing at step 122 to 138, the CPU 21 deactivates at step 126 the compressor 14. cooling fan 18 of condenser 15 and cooling blower 17 and activates the defrost heater 16 at the control routine of step 126 to remove frosts adhered to the evaporator 16. When the defrost temperature T2 detected by the defrost sensor 32 becomes higher than a predetermined temperature, the defrost heater 16 is deactivated, and the compressor 14, cooling fan 18 of condenser 15 and the cooling fan 17 in cooling chamber 12 are activated again. When the refrigerant temperature T3 detected by the clog sensor 33 becomes higher in excess, the CPU 21 issues an alarm therefrom by processing at step 128.

From the above description, it will be understood that if the power source switch 42 is closed to operate the refrigerator for test in a condition where the operation switch 35 has been closed, the indicator 36 is activated by processing at step 102 to 114, 128 and 136 to display the type of the electric controller 20A for the predetermined time (for example, 30 sec), on a basis of the data memorized in the EEPROM 22. With the indicator 36 activated under control of the CPU 21, an error in installation of the electric controller 20A can be found by an inspector in charge for shipment of the refrigerator to avoid shipment of the refrigerator equipped with a difference electric controller. As in the above embodiment, the operation switch 35 and the indicator 36 for display of the detected inside temperature T1 and set temperature Ts are adapted to display the type of the refrigerator for inspection, the manufacturing cost can be reduced without providing any parts for inspection.

In use of the refrigerator, the power source switch 42 is closed in a condition where the operation switch 35 is maintained in its open position. In such an instance, the indicator 36 is activated by processing at step 110, 112, 128 and 132 to display the detected inside temperature T1 of the refrigerator without displaying the type of the electric controller 20A. When the operation switch 35 is closed after inspection of the electric controller 20A in a condition where the type of the electric controller 20A is being displayed on the indicator 36, the CPU 21 causes the indicator 36 by processing at step 118 and 120 to release the display of the type or the electric controller 20A and to display the detected inside temperature T1 and set temperature Ts for use of the refrigerator. This is useful to quickly finish the inspection of the electric controller for shipment of the refrigerator. In addition, the CPU 21 causes the indicator 36 by processing at step 102, 104 and 114 to display the type of the installed electric controller 20A for the predetermined short time irrespectively of operation of the operation switch 35. This is useful to prevent the indicator 36 from abnormal display of the detected inside temperature T1 and set temperature Ts caused by unstable conditions of the sensor 31 and temperature setting device 34 immediately after applied with the power-supply voltage.

Although in the above embodiment, the present invention has been adapted to an electric refrigerator, the present invention may be adapted to various electric appliances equipped with an electric controller such as a microcomputer for operation control of the electric appliance. In addition, the indicator for display of the type of the electric controller may be provided with a plurality of indication lamps which are turned on and off to indicate each type of plural electric controllers. In such a case, it is preferable that the indication lamps are arranged to be selectively turned on and off when the flag FLG is "1" and to be turned off when the flag FLG is changed to "0".

What is claimed is:

1. An electric appliance equipped with an operation switch, an indicator and an electric controller for controlling operation of the appliance when connected to a source of electric power, wherein said electric controller comprises:

memory means for memorizing a data indicative of the type of said electric controller; and means for activating said indicator to display the type of said electric controller for a predetermined time based on the memorized data when said electric appliance is connected to the source of electric power in a condition where said operation switch was closed and for disabling said indicator to display the type of said electric controller when said electric appliance is connected to the source of electric power in a condition where said operation switch is maintained in an open position.

2. A refrigerator equipped with a temperature sensor for detecting an inside temperature of the refrigerator, a temperature setting device for setting the inside temperature of the refrigerator to a desired temperature, a freezing device composed of a compressor, a condenser and an evaporator, an indicator arranged to be activated under control of an operation switch to display the inside temperature of the refrigerator detected by said temperature sensor and the desired temperature set by said temperature setting device, and an electric controller for controlling said freezing device in such a manner that the inside temperature of the refrigerator is maintained at the desired temperature set by said temperature setting device and for activating said indicator to display the inside temperature of the refrigerator detected by said temperature sensor or the desired temperature set by said temperature setting device under control of said operation switch, wherein said electric controller comprises memory means for memorizing a data indicative of the type of said electric controller, and means for activating said indicator to display the type of said electric controller based on the memorized data for a predetermined time when the refrigerator is connected to a source of electric power in a condition where said operation switch was closed and for disabling said indicator to display the type of said electric controller when the refrigerator is connected to the source of electric power in a condition where said operation switch is maintained in an open position.

3. A refrigerator as claimed in claim 2, wherein said electric controller further comprises means for causing said indicator to release the display of the type of said electric controller when said operation switch is closed while the type of said electric controller is being displayed by said indicator.

4. A refrigerator as claimed in claim 2, wherein said electric controller further comprises means for activating said indicator to display the type of said electric controller based on the memorized data for a predetermined short time irrespectively of operation of said operation switch immediately after the refrigerator was connected to the source of electric power.

* * * * *